United States Patent [19]

Lin et al.

[11] 4,004,891

[45] Jan. 25, 1977

[54] SUPERALLOYS CONTAINING NITRIDES AND PROCESS FOR PRODUCING SAME

[75] Inventors: Ching San Lin, Sayre; James Thomas Smith, Towanda, both of Pa.

[73] Assignee: GTE Sylvania Incorporated, Stamford, Conn.

[22] Filed: Feb. 5, 1975

[21] Appl. No.: 547,110

Related U.S. Application Data

[63] Continuation of Ser. No. 343,873, March 22, 1973, abandoned, which is a continuation of Ser. No. 146,198, May 24, 1971, abandoned.

[52] U.S. Cl. ..... 29/182.5; 75/170

[51] Int. Cl.[2] ..... B22F 5/00

[58] Field of Search ..... 75/205, 170; 29/182.5; 148/126

[56] References Cited

UNITED STATES PATENTS

| | | | |
|---|---|---|---|
| 2,823,988 | 2/1958 | Grant et al. | 75/.5 |
| 3,459,546 | 8/1969 | Lambert | 75/205 |
| 3,720,551 | 3/1973 | Allen | 148/126 |

*Primary Examiner*—Brooks H. Hunt
*Attorney, Agent, or Firm*—Norman J. O'Malley; Donald R. Castle; William H. McNeill

[57] ABSTRACT

Superalloys containing uniform dispersions of at least 0.1 volume percent of a metal nitride improve qualities of superalloys. These superalloys are produced from superalloy powders by a nitridng process utilizing a controlled atmosphere for controlled times at controlled temperature. A nitriding temperature of at least 700° C is required in order to produce effective amounts of nitride in practical lengths of time.

1 Claim, 1 Drawing Figure

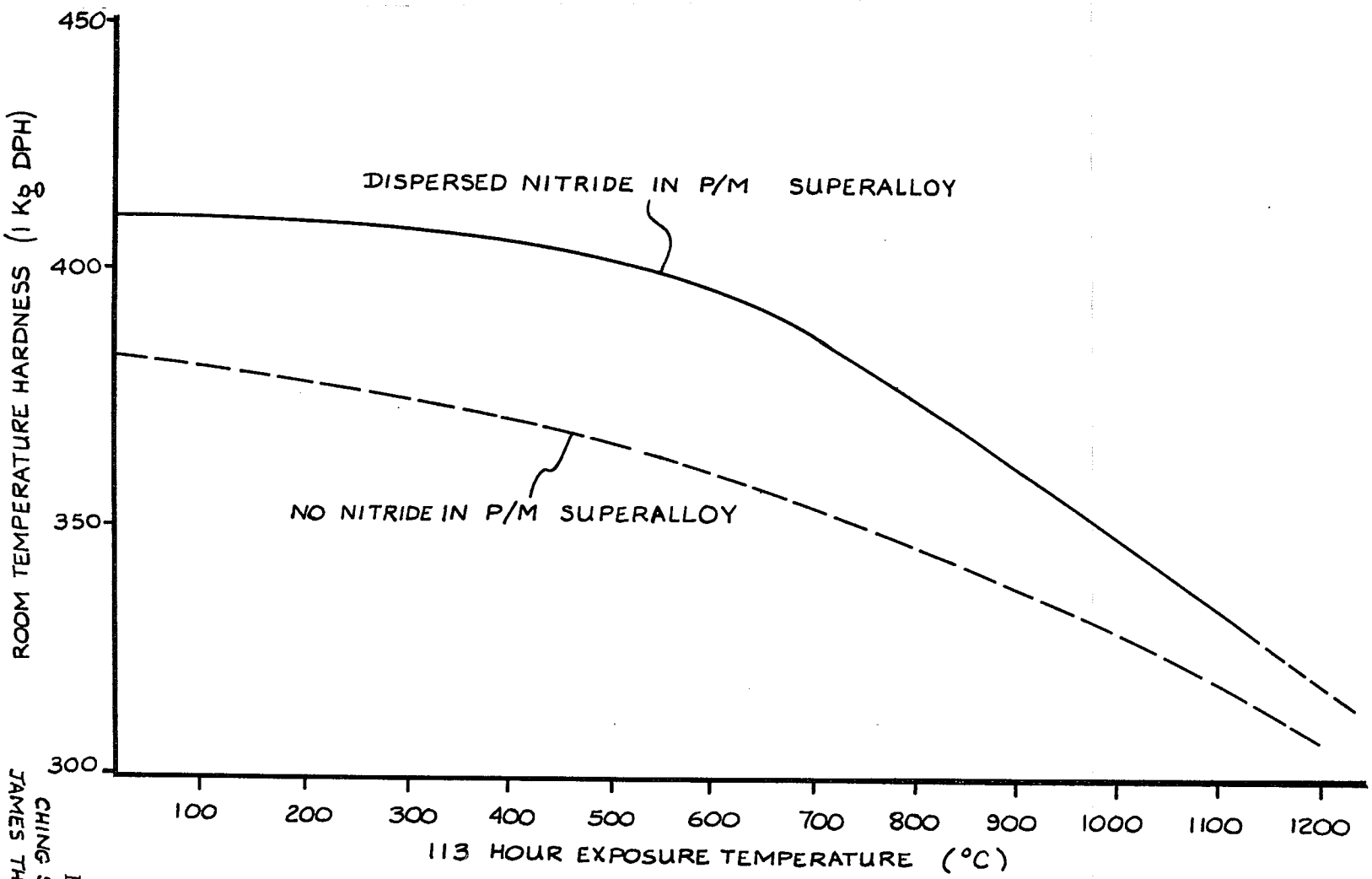
INVENTOR
CHING SAN LIN &
JAMES THOMAS SMITH
BY Donald R. Castle
ATTORNEY

SUPERALLOYS CONTAINING NITRIDES AND PROCESS FOR PRODUCING SAME

CROSS-REFERENCE TO RELATED APPLICATION

This application is a continuation of Ser. No. 343,873, filed: Mar. 22, 1973, which was a continuation of Ser. No. 146,198, filed: May 24, 1971. Both of the foregoing applications were assigned to the assignee of the present invention. Both of the above applications are now abandoned.

There is disclosed in U.S. patent application Ser. No. 146,142, filed concurrently herewith and assigned to the same assignee as the present application, superalloy powders having a freedom of impurities and a method for producing same. The process comprises using controlled induction melting of certain materials, applying a centrifugal force to the melt to form droplets, cooling the droplets to discrete particles in an inert gas atmosphere. In the present invention nitrides of certain components of the superalloy powders are formed which beneficially effect the properties of superalloys. The powders disclosed in the related application are suitable raw materials for the powders of this invention, although other superalloy powders can be used.

BACKGROUND OF THE INVENTION

This invention relates to nickel base superalloy materials having improved strength and stabilization. More particularly, it relates to the strengthening and stabilization of the superalloy by uniform dispersion of metal nitride phases.

"Superalloys" is a generic name given to certain nickel base alloys having a unique microstructure. The alloys are further characterized by their heat resistance and high strength. These alloys generally contain from about 50 to about 75 weight percent of nickel alloyed with varying amounts of chromium, cobalt, aluminum, titanium, molybdenum, tungsten, niobium, tantalum, boron, zirconium and carbon. The metallurgical composition of superalloys are known such as those compiled in the ASTM Subcomittee XII Report, published by the Metal Processing Division of Curtiss-Wright Corporation. In the 8th edition of the Metals Handbook "Superalloys" are defined as alloys developed for high temperature service where relative high stresses (tensile, thermal, vibratory and shock) are encountered and where oxidation resistance is frequently required, and is the definition used herein. Typical alloys are supplied by a variety of suppliers under tradenames of IN-100, Astroloy, etc.

The prior art teaches that superalloys can be strengthened and stabilized by solid solution methods and by the formation of fine carbides from the elements of titanium, zirconium, tantalum, columbium, molybdenum, tungsten and chromium. Other materials which strengthen and stabilize superalloys are oxide dispersions such as alumina and yttria. The disadvantages of carbide strengthened alloys are that due to the carbide overaging deterioration of ductility occurs. Additionally, unless there is a uniform distribution of the carbides throughout the superalloy there is non-uniform ductility. The oxide dispered superalloys have a critical manufacturing technique which is expensive and time consuming. Additionally, there can be undesired effects such as large dispersoids, excessive oxygen content and impurities which can be introduced during the manufacturing. These effects result in undesired changes in certain properties of the superalloys.

U.S. Pat. No. 3,591,362, issued July 6, 1971, describes a process for producing various dispersion strengthened materials via a process in which a "dispersed" phase in a compound form is mechanically beaten into the parent or host metal. While the milling procedure disclosed therein has advantages in producing many products, the degree of dispersion is dependent upon energy input. As a result, energy requirements are high and uniformity of dispersion varies with the amount of dispersed phase employed. Additionally, the process requires a distinct compound for each dispersant. In addition, the product is dependent upon the original particle size of the dispersed material. In some instances it is impossible to achieve submicron size compounds for dispersion into the present metal.

It is believed, therefore, that a superalloy having a desired strengthening and stabilization additive which overcomes is an advancement in the art. Further, it is believed that a process which enables the production of such alloys in a simple manner is a further advancement in the art.

SUMMARY OF THE INVENTION

In accordance with one aspect of this invention, a superalloy containing at least about 0.1% by volume of a uniformly dispersed metal nitride is provided to strengthen and stabilize the superalloys.

According to another aspect of this invention, the foregoing alloys are prepared by heating superalloy powders in a nitrogen atmosphere for selected time intervals to chemically bind the nitrogen as a metal nitride and form at least about 0.1% by volume of a metal nitride.

BRIEF DESCRPTION OF THE DRAWING

FIG. 1 is a graph showing properties of the alloys of this invention compared to prior art superalloys.

DETAILED DESCRIPTION OF THE PREFERRED EMBODIMENTS

For a better understanding of the present invention, together with other and further objects, advantages and capabilities thereof, reference is made to the following disclosure and appended claims in connection with the above-described drawing.

Although any superalloy powder can be processed to form the improved superalloy powders of this invention, it is preferred to use powders disclosed and claimed by the cross-referenced patent application since these powders afford certain beneficial surface area characteristics. In general, the powders of this invention are prepared by heating superalloy powders under controlled nitrogen atmosphere for a controlled temperature range for a sufficient time to form the desired amount of metal nitrides. The superalloys now in commercial use generally contain titanium and it is preferentially converted to titanium nitride, then other metallic nitrides are formed. The metal nitride stabilization and strengthening occurs regardless of the metal nitride formed, therefore, the invention is not limited to the titanium nitride formation. It is the uniform dispersion of the metal nitride that achieves the beneficial results.

Although small amounts, even as small as 0.1 volume percent of a metal nitride improve certain qualities of the superalloys and from about 0.1 to about 5% by volume of metal nitrides are preferred with from about 0.5 to about 2.0% being especially preferred. Amounts of metal nitrides above about 5% generally require excessive processing time. In most instances the nitrides will be in the form of titanium, zirconium and aluminum nitride. Since the larger amounts, that is above about 5% by volume, add no appreciable benefits to the superalloys there is no practical reason for these higher amounts to be used.

An atmosphere preferably a mixture of nitrogen and an inert gas can be used, although a pure nitrogen atmosphere can be used if desired. If a mixture of nitrogen and inert gas is used, above about 10% by volume of nitrogen is preferred. A temperature of at least 700° C is used during the nitriding. At temperature below about 700° C no appreciable amounts of nitrides are formed within practical time limitations. At temperatures approaching about 950° C the time required to convert the titanium present in most superalloys is relatively short, that is less than about 3 to 4 hours, therefore, lower temperatures are generally used since strengthening is not appreciably effected by increasing the metal nitride content above about 5%. In view of the above, temperatures between about 750° C and 850° C are preferred for a nitriding time of from about 4 to about 8 hours being preferred. Although the lower temperatures within the foregoing range require longer heating times these lower temperatures are preferred since after forging the lower temperatures promote smaller particle sizes which is generally preferred in most superalloy materials. To more fully illustrate the subject invention, the following detailed examples are presented. All parts and percentages are given by weight unless otherwise indicated.

EXAMPLE 1

A bar of a cast IN-100 superalloy, a trademark of International Nickel and an alloy sold by many suppliers is converted to a powder as disclosed in U.S. patent application Ser. No. 146,142. The resulting powder is nitrided at various temperatures and times as shown in Table 1. The analysis of samples of the powder is also given in Table 1.

TABLE I

| Nitriding Parameters Temperature °C | Time Hour | Nitrogen Content Weight % | IN-100 Relative X-Ray Intensity d=2.44° A | d=2.12° A | d=1.5° A | Metal Nitride (1) in Superalloy Volume % (Calculated) |
|---|---|---|---|---|---|---|
| As Received | powder | 0.008 | VW | W | — | — |
| 650 | 4 | 0.008 | W | W | VW | — |
| 700 | 4 | 0.014 | W | M | VW | 0.09 |
| 750 | 4 | 0.054 | W | S | VW | 0.34 |
| 800 | 4 | 0.140 | W | S | VW | 0.88 |
| 850 | 4 | 0.485 | M | S | VW | 3.04 |
| 750 | 9 | 0.67 | W | S | VW | 0.42 |

(1) The X-Ray diffraction pattern indicates the nitride is bound as titanium nitride. Photomicrographs of the nitrided material show the metal nitride particles are uniformly dispersed and are approximately equal to the volume percent calculated.

After the powders are nitrided as described above, they are hydrostatically compacted to a shape which will support itself without external support, the shape is thereafter sintered or forged to full density. The metal nitride, as shown by photomicrographs, is uniformly dispersed throughout the alloy. The alloy particle boundaries have apparently disappeared by the pressing, forging and sintering processes. The prepared alloys have a better resistance to high temperature softening, for example, 113 hours of exposure at 540° C, the room temperature hardness is increased from 365 DPH-1 Kg without the nitride material to 402 DPH-1 Kg with the nitrided material. Comparable results are obtained through the temperature range of from room temperature to 1150° C, as shown in FIG. 1. The foregoing processes are also used to convert aluminum and zirconium to their respective nitrides with significant advantages achieved in the high temperatures stabilization of the superalloys.

EXAMPLE II

A series of runs are conducted to determine the conditions required to form metal nitride in Astroloy superalloy powders. Table 2 summarizes quantitative nitriding studies with Astroloy superalloy powders. These results indicate that the metal nitride is formed in the Astroloy powder. The volume of metal nitride produced can be controlled by the selection of the nitriding temperature, time and nitrogen content of the atmosphere.

TABLE 2

| Nitriding Parameters Temperature °C | Time Hour | Nitrogen Content Weight % | | Astrology Relative X-Ray Intensity d=2.44 A | d=2.12 A | Metal Nitride (1) in Astrology Volume % (calculated) |
|---|---|---|---|---|---|---|
| As Received | powder | 0.0025 | 0.0031 | — | W | — |
| 700 | 4 | 0.049 | | VW | M | 0.32 |
| 750 | 4 | 0.355 | | W | S | 2.30 |
| 800 | 4 | 0.94 | | S | S | 6.27 |
| 850 | 4 | 0.98 | | S | S | 6.27 |
| 750 | 9 | 0.74 | | M | S | 4.76 |

(1) X-Ray diffraction data shows the nitride to be titanium nitride. Volume percent of the nitrides from photomicrograph compares favorably with calculated amount and shows a uniform dispersion of metal nitrides.

EXAMPLE III

Standard testing samples of IN-100 superalloys are prepared by three different methods for ASTM teating for yield and tensile strength and ductility. Each sample is identically heat treated using solution annealing and $\gamma'$ aging. Sample 1 is cast IN-100, Sample 2 is prepared by powder metallurgy as disclosed in the reference copending patent application and Sample 3 is prepared by the method disclosed herein and is analyzed to contain 2% by volume of metal nitride. Results of test are given below:

| Sample | Tensile Strength psi | Yield Strength psi | Elongation % |
|---|---|---|---|
| 1 | 147,700 | 131,100 | 9 |
| 2 | 185,000 | 160,300 | 5 |
| 3 | 204,450 | 166,850 | 6.5 |

The above results conclusively indicate a major increase in tensile and yield strength without a significant decrease in ductility.

While there have been shown and described what are at present considered the preferred embodiments of the invention, it will be obvious to those skilled in the art that various changes and modifications may be made therein without departing from the scope of the invention as defined by the appended claims.

What is claimed is:

1. A superalloy composition resulting from a process wherein a first superalloy composition having a predetermined atomic ratio of metallic elements, containing from about 50 to about 75 weight percent of nickel, and having a second metal selected from the group consisting of titanium, aluminum, zirconium, and additional metallic materials alloyed with said nickel, is converted to a second superalloy composition by nitriding said second metal to form a dispersion of a metal nitride selected from the group consisting of titanium nitride, aluminum nitride, zirconium nitride, and mixtures thereof; and said second superalloy having the same atomic ratio of metals as said on first superalloy composition when said metal nitride is calculated on the basis of the metallic content thereof.

* * * * *

UNITED STATES PATENT OFFICE

CERTIFICATE OF CORRECTION

Patent No. 4,004,891 Dated January 25, 1977

Inventor(s) Ching San Lin et al.

It is certified that error appears in the above-identified patent and that said Letters Patent are hereby corrected as shown below:

ABSTRACT [57], line 4 - Please delete "nitridng" and insert -- nitriding --.

Col. 1, line 64 - Please delete "dispered" and insert -- dispersed --.

Col. 2, line 20 - After "overcomes", please insert -- the disadvantages present in the prior art compositions, --.

Table 2 (Subheading) - Please delete "Astrology" and insert -- Astroloy --.

UNITED STATES PATENT OFFICE

CERTIFICATE OF CORRECTION

Patent No. 4,004,891 Dated January 25, 1977

Inventor(s) Ching San Lin et al Page 2 of 2

It is certified that error appears in the above-identified patent and that said Letters Patent are hereby corrected as shown below:

Table 2
(Subheading) - Under "Relative X-Ray Intensity" please delete "d = 2.44 A d = 2.12 A" and insert -- d = 2.44°A d = 2.12°A --.

Table 2
(Subheading) - Delete "Metal Nitride (1) in Astrology" and insert -- Metal Nitride (1) in Astroloy --.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*